US007306526B2

(12) United States Patent
Baek

(10) Patent No.: US 7,306,526 B2
(45) Date of Patent: Dec. 11, 2007

(54) GOLF PUTTER

(76) Inventor: Kyung Tae Baek, 1049-1 Chimsan-dong, Buk-gu, Daegu-city (KR)

( * ) Notice: Subject to any disclaimer, the term of this patent is extended or adjusted under 35 U.S.C. 154(b) by 173 days.

(21) Appl. No.: 10/976,024

(22) Filed: Oct. 29, 2004

(65) Prior Publication Data

US 2005/0215348 A1 Sep. 29, 2005

(30) Foreign Application Priority Data

Mar. 25, 2004 (KR) ..... 10-2004-0020322

(51) Int. Cl.
*A63B 53/14* (2006.01)

(52) U.S. Cl. ..... 473/294; 473/298; 473/300; 473/314

(58) Field of Classification Search ..... 473/300–303, 473/316, 313, 314, 340, 549, 292, 294, 296, 473/297

See application file for complete search history.

(56) References Cited

U.S. PATENT DOCUMENTS 2,218,268 A 10/1940 Reid
2,876,010 A 3/1959 Hugman
3,332,684 A * 7/1967 Solheim ..... 473/314
4,269,412 A * 5/1981 Hughes ..... 473/204
4,553,753 A * 11/1985 Gibbons ..... 473/560
4,625,965 A 12/1986 Mullins
5,454,564 A * 10/1995 Kronogard ..... 473/201
5,460,372 A * 10/1995 Cook ..... 473/204
5,616,089 A * 4/1997 Miller ..... 473/409
5,746,661 A * 5/1998 Murphy ..... 473/204
5,782,705 A 7/1998 Solari
6,110,054 A * 8/2000 Rodarte ..... 473/203
6,743,115 B2 * 6/2004 Rodarte ..... 473/294
6,783,463 B2 * 8/2004 Zichmanis ..... 473/204

OTHER PUBLICATIONS

European Search Report for Application No. EP 05 25 1872, dated Aug. 2, 2005.

* cited by examiner

*Primary Examiner*—William M. Pierce
(74) *Attorney, Agent, or Firm*—Nixon Peabody LLP; Jeffrey L. Costellia

(57) ABSTRACT

The present invention is directed to a golf putter and an associated method of use with which an experienced golfer can maintain a stable posture during putting and an inexperienced golfer can easily perform putting. The golf putter comprises a shaft, a grip located at an end of the shaft, and a head which is connected to the other end of the shaft and strikes a golf ball in a target direction. The grip includes a first grip portion, where a side of an end of the first grip portion protrudes in a direction opposite to the target direction, and a second grip portion, which extends from the first grip portion toward the head and is gently curved. The shaft extends up to the end of the first grip portion through the grip.

11 Claims, 7 Drawing Sheets

GOLF PUTTER

BACKGROUND OF THE INVENTION

This application claims priority to Korean Patent Application No. 2004-20322, filed on Mar. 25, 2004, in the Korean Intellectual Property Office, the disclosure of which is incorporated by reference herein in its entirety.

FIELD OF THE INVENTION

The present invention relates to a golf putter, and more particularly, to a golf putter with which a golfer can maintain a stable posture from the point of addressing the ball to impacting the ball with the putter.

DESCRIPTION OF THE RELATED ART

A golf putter as shown in FIG. 1 is used for putting. The golf putter includes a grip 10 which is gripped by hands of a golfer, a shaft 20 which is connected to the grip 10, and a head 30 which is combined with an end of the shaft 20. As illustrated in FIG. 1, the head 30 is formed so as to provide a small loft to a struck ball.

It is very important to adopt a correct, stable posture in order to perform effective putting. In general, addressing the ball for putting refers to a preparatory process for striking the golf ball. As shown in FIG. 2, when addressing the ball, the head and wrists of a golfer are in fixed positions so as to maintain a triangle composition made by both shoulders and hands of the golfer. In this posture, the golfer performs a stroke, with a motion similar to that of a pendulum of a clock back swing.

In addressing the ball, as shown in FIG. 2, it is most important to maintain a pentagon composition made by both shoulders A and B of the golfer, a point C at which both hands of the golfer grip the grip 10, and both elbows of the golfer, and a triangle composition made by points A, B, and D.

However, the pentagon composition is usually not accurately made because the golfer frequently adjusts his/her posture and thus loses the pentagon composition and the A-B-D triangle composition while addressing the ball by bending the joints of the wrists and arms or turning the head during putting. Thus, repeated practice must be performed for a stable pentagon composition.

Some golfers use a long putter with a long shaft instead of a general putter to maintain a more stable, correct puffing posture. However, although some golfers use a long putter, they cannot but bend their joints. Thus, there is a need for a putter and associated method of use that reduce the time and effort required for properly addressing and striking the ball and simultaneously be useful to different skilled and sized golfers.

U.S. Pat. No. 4,625,965 discloses a golf putter. The golf puffer includes a grip, bent in a direction opposite to a direction along which a golf ball advances. The putter has a lower end portion that extends along a general straight axis of a shaft and an upper portion that is bent at an angle of about 20° in the opposite direction to the direction along which the golf ball advances. The golf putter is made so that a hand of the golfer gripping the bent upper portion of the grip contacts an arm of the golfer gripping the lower end portion to maintain a stable, correct posture.

However, the upper end portion of the golf putter is bent with respect to a shaft. Thus, the golf putter does not satisfy the standards of the United States Golf Association which stipules that a shaft must remain straight. Therefore, the golf putter may be used for practice but not for an actual golf game. Also, the shaft is perpendicular to the ground during putting. Thus, during an address of the ball or when impacting the ball, the posture of a golfer may deteriorate and angles of elbows and wrists of the golfer may change.

SUMMARY OF THE INVENTION

The present invention provides a golf puffer with which an experienced golfer can maintain a more stable, correct posture during puffing and with which an inexperienced golfer can also more easily perform puffing.

According to an aspect of the present invention, there is provided a golf putter. The golf putter includes a shaft, a grip located at an end of the shaft, and a head which is connected to the other end of the shaft and which strikes a golf ball in a target direction. The grip includes a first grip portion, where a side of an end of the first grip portion protrudes in a direction opposite to the target direction, and a second grip portion, which extends from the first grip portion toward the head and is curved. The shaft extends up to the end of the first grip portion through the grip.

According to another aspect of the present invention, a golf putter is disclosed that includes a shaft, a grip located at an end of the shaft, and a head which is connected to the other end of the shaft and which strikes a golf ball in a target direction. The grip further includes a first grip portion, where an end of the first grip portion protrudes in a direction opposite to the target direction and the end of the first grip portion is gripped by a hand of a golfer located in the target direction. The grip further includes a second grip portion which extends from the first grip portion toward the head in a curved fashion and which is gripped by a hand of the golfer located in the opposite direction to the target direction. At least one finger of the hand gripping the first grip portion does not grip the first grip portion and contacts a contact point of an inner portion of an elbow of an arm located in the opposite direction to the target direction, so that a wrist joint of the hand gripping the second grip portion, the contact point, and a wrist joint of the hand gripping the first grip portion maintain a triangle composition.

In accordance with yet another aspect of the present invention a method for gripping and swinging a golf club is provided. The golf club includes a shaft, a grip located at an end of the shaft and a head which is connected to the other end of the shaft and which strikes a golf ball in a target direction. The method includes gripping a first portion of the grip with a first hand of a golfer located in the target direction of the golf ball, gripping a second portion of the grip with a second hand of the golfer located opposite to the target direction of the golf ball, and contacting, with at least a portion of the first hand, a contact point of an inner portion of an elbow of an arm associated with the second hand.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, an exemplary embodiment of the present invention will be described in detail with reference to the attached drawings.

Figure 1:
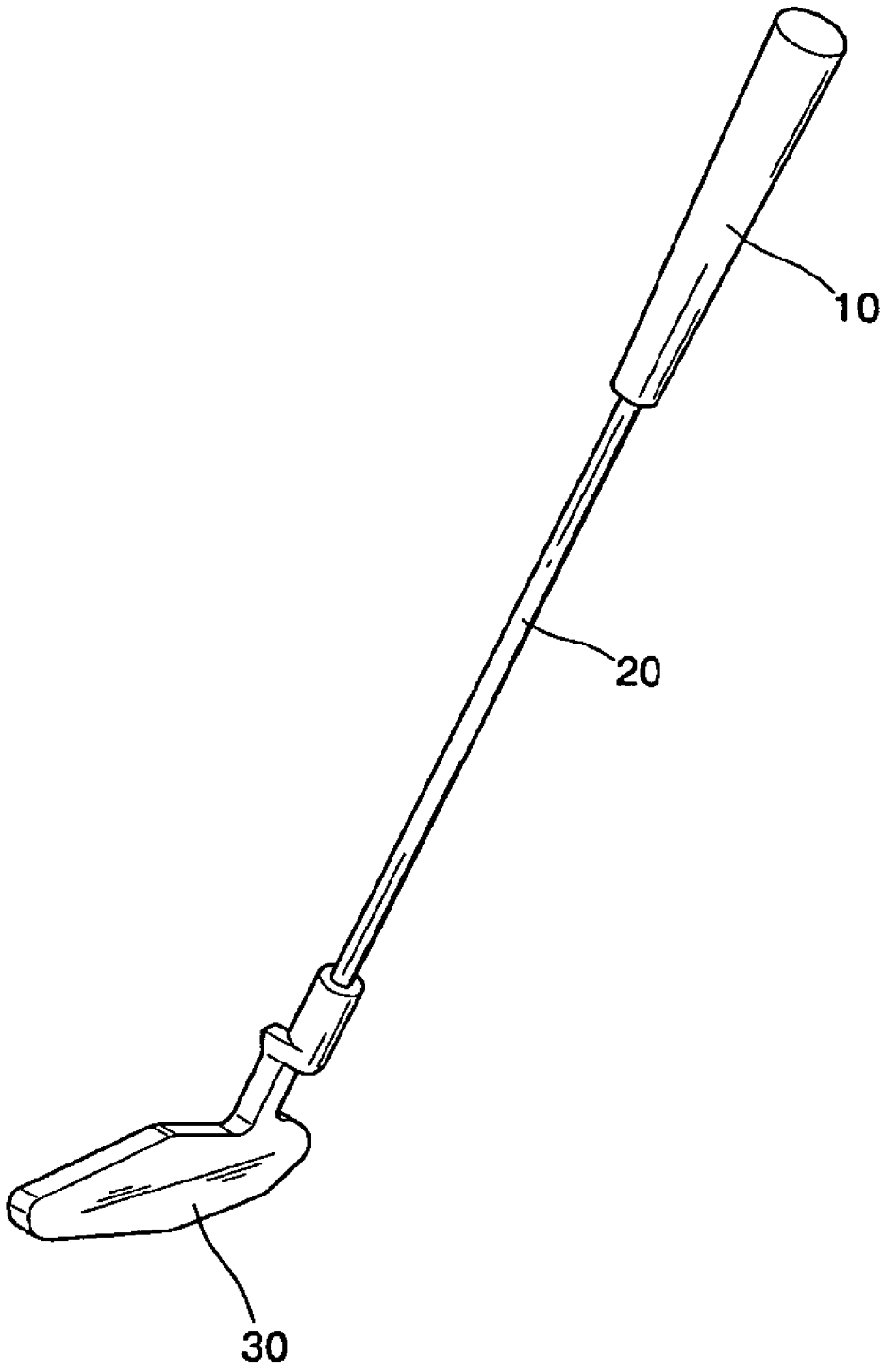
FIG. 1 (PRIOR ART)
FIG. 1 is a perspective view of a conventional golf putter.
Figure 2:
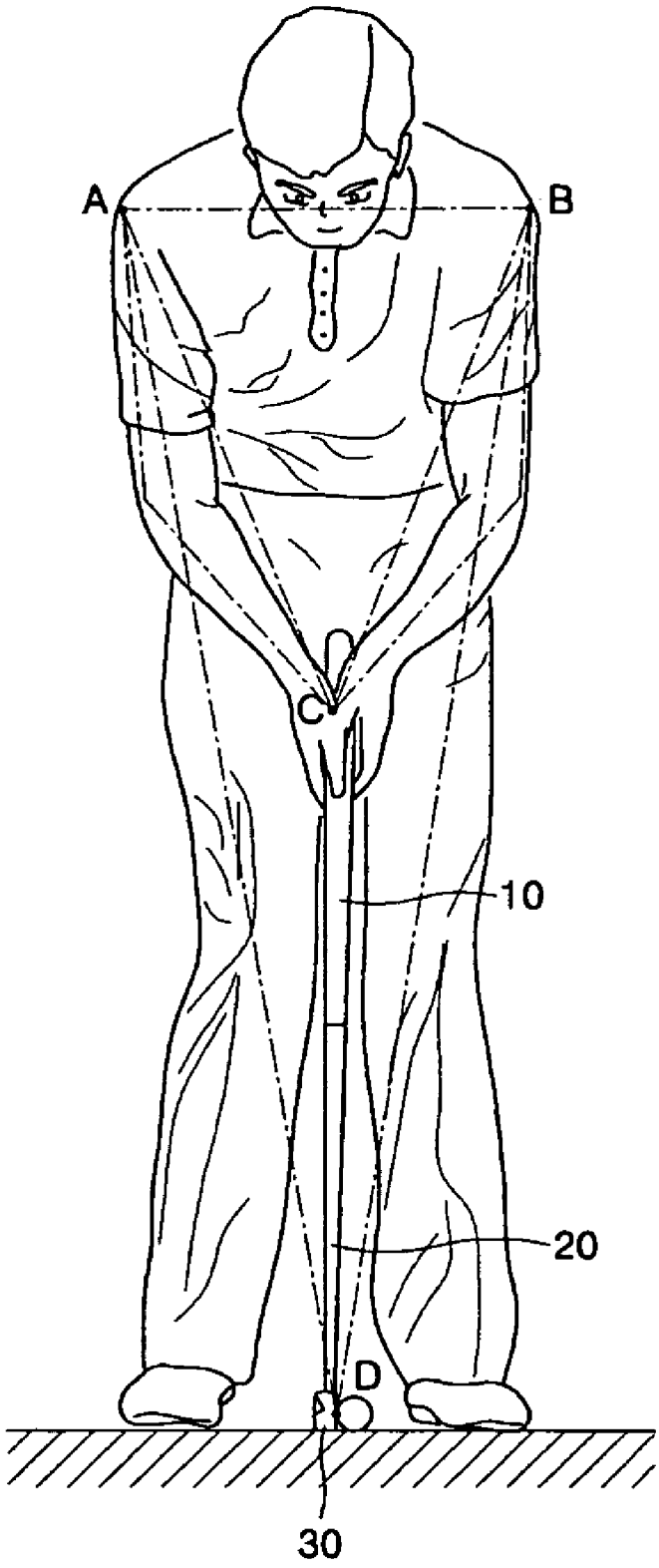
FIG. 2 (PRIOR ART)
FIG. 2 is a schematic view for showing a front view of a golfer who takes the posture of an address using the conventional golf putter.
Figure 3:
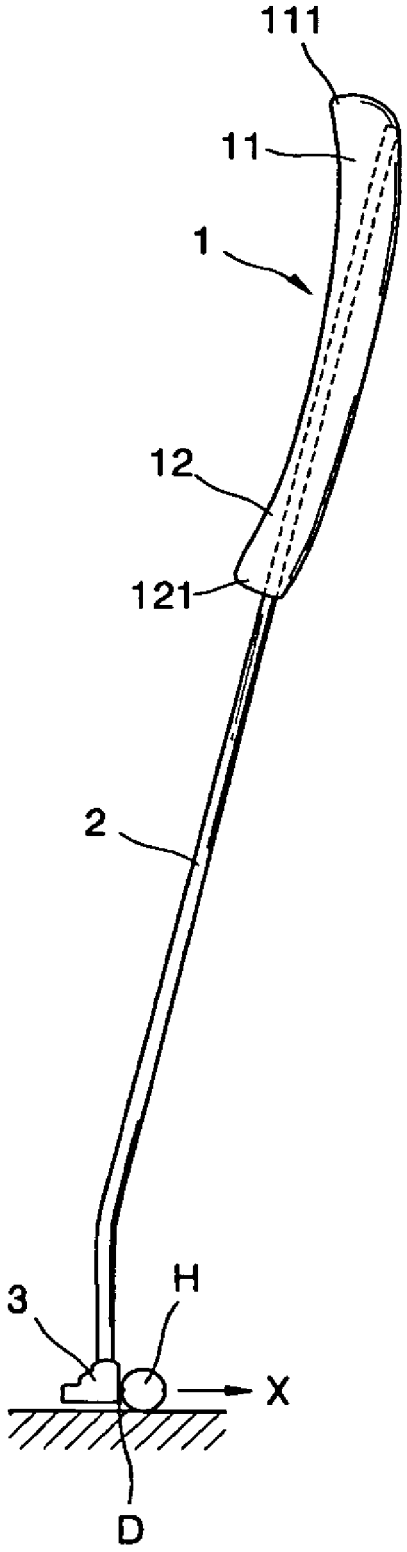
FIG. 3 is a front view of a golf putter, according to an exemplary embodiment of the present invention.
Figure 4:
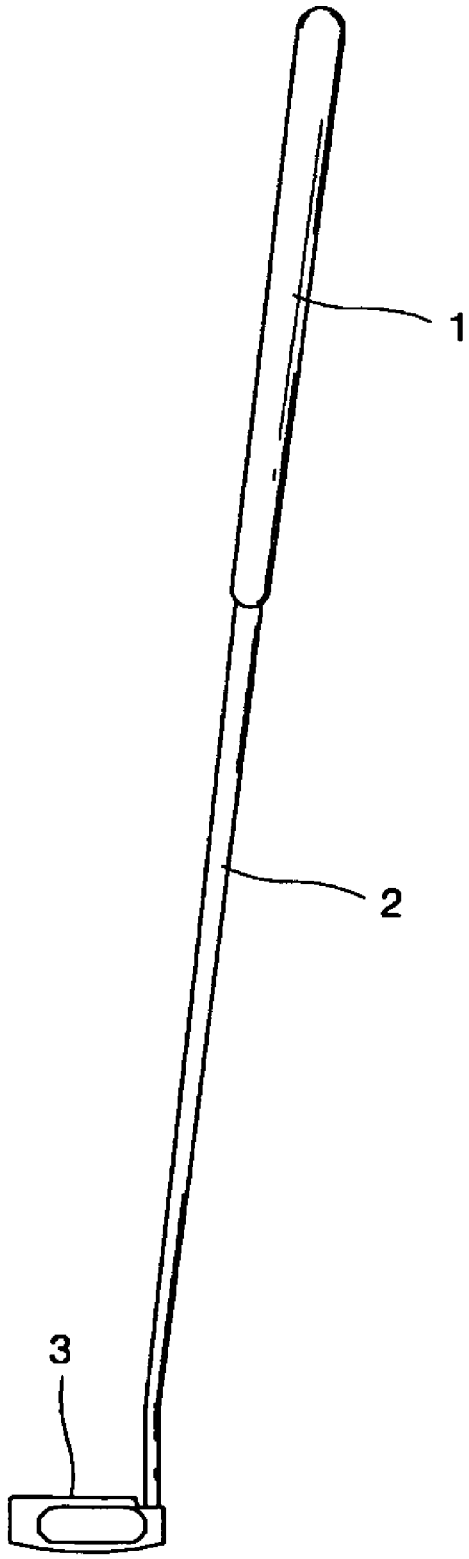
FIG. 4 is a side view of the golf putter of FIG. 3.
Figure 5:
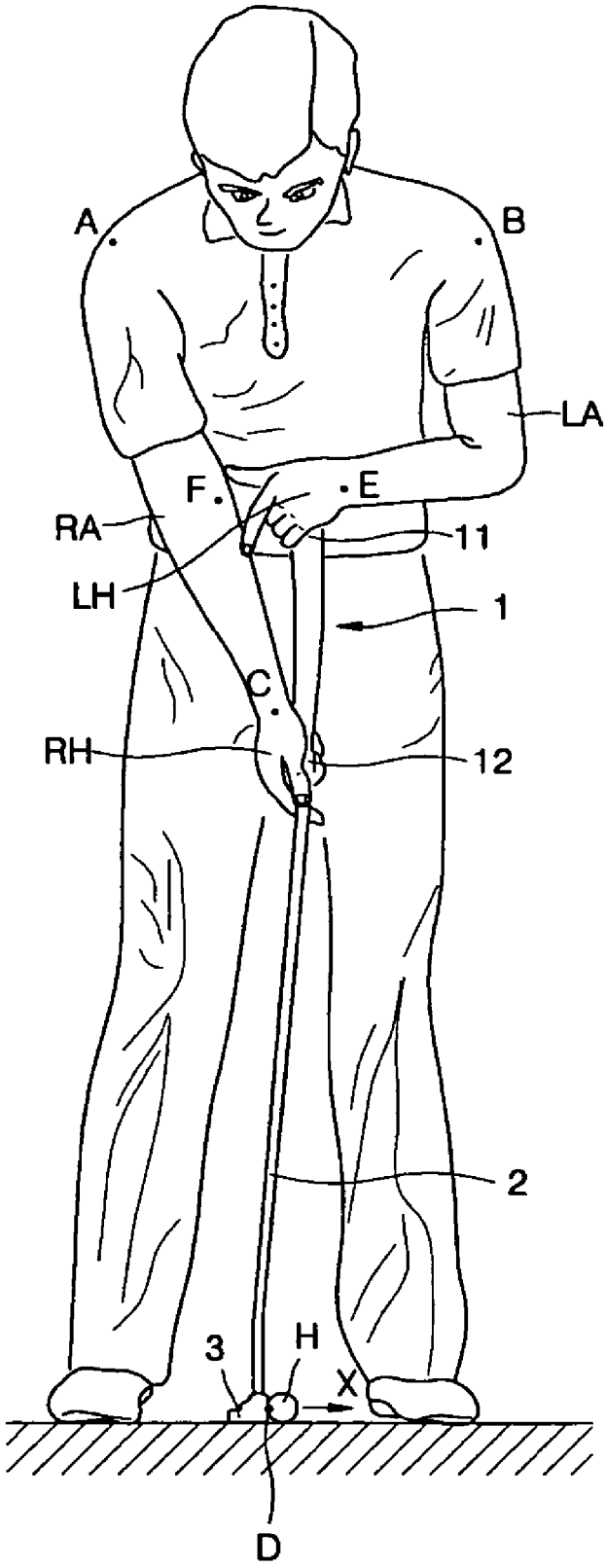
FIG. 5 is a schematic view for showing a front view of a golfer gripping the golf putter of FIG. 3.
Figure 6:
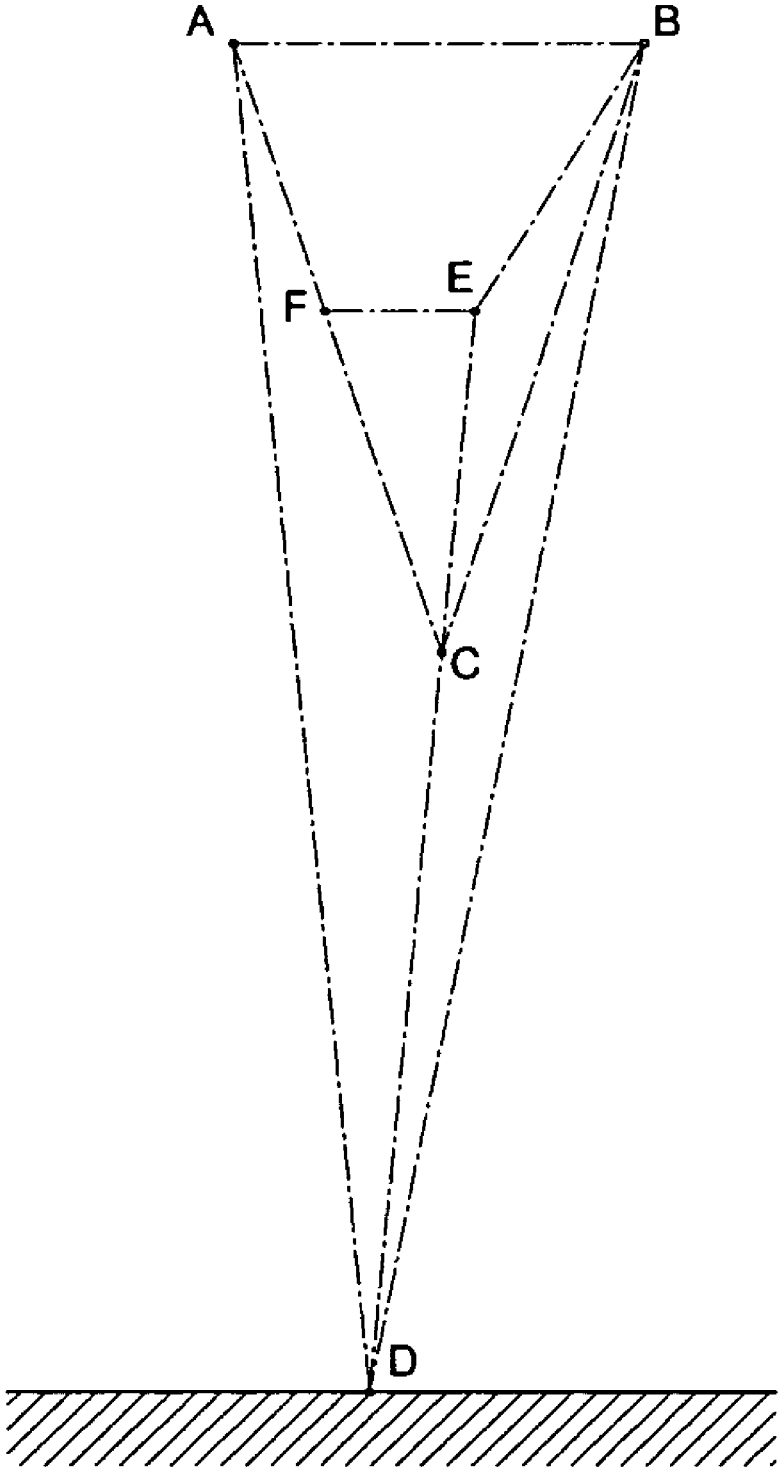
FIG. 6 is a schematic view for showing connections among points of FIG. 5 to explain a putting method using the golf putter of the present invention.
Figure 7:
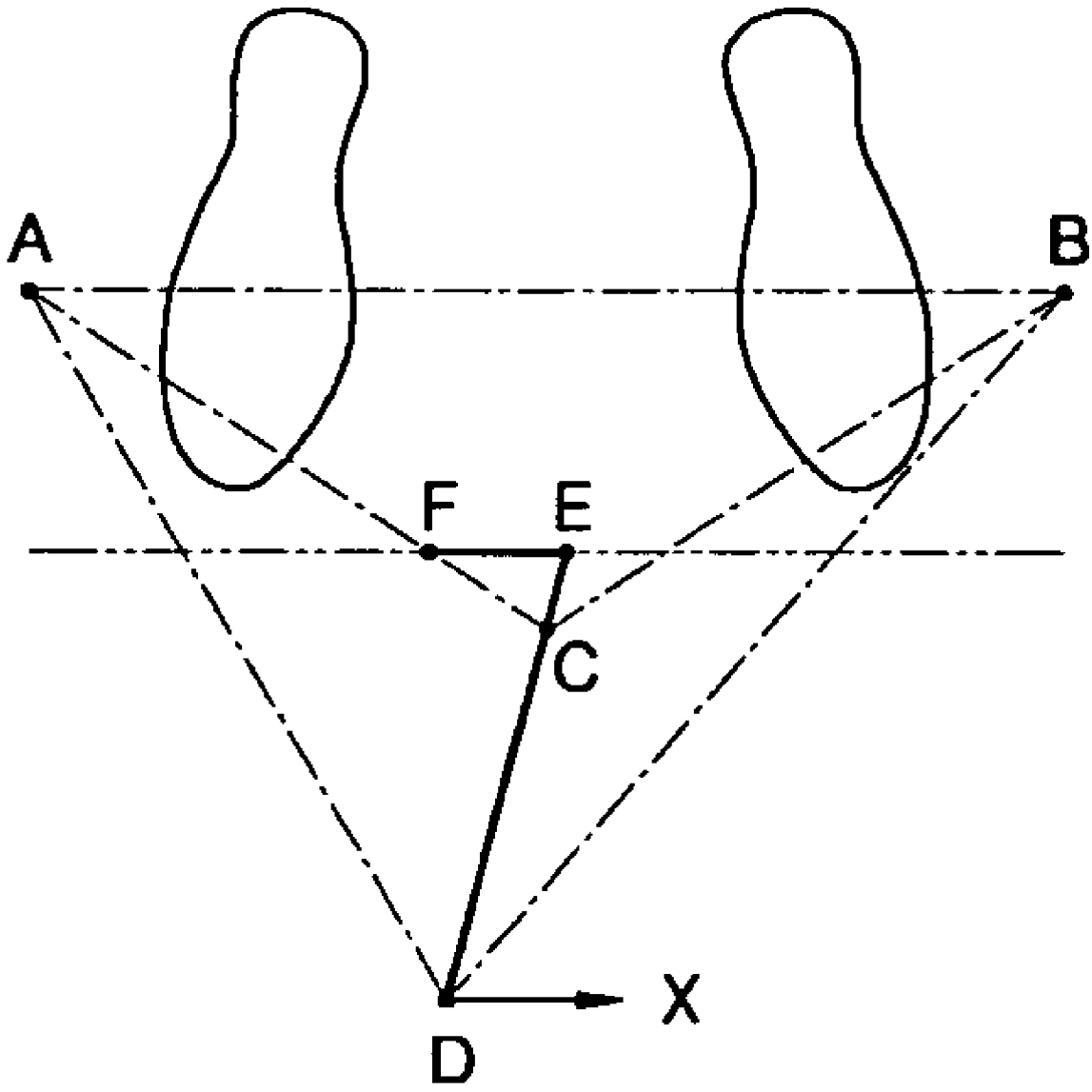
FIG. 7 is a schematic view for showing the relationships among the points of FIG. 5 from an aerial view over the golfer.

FIG. 3 is a front view of a golf putter, according to an exemplary embodiment of the present invention, FIG. 4 is a side view of the golf putter of FIG. 3, FIG. 5 is a schematic view for showing a front view of a golfer who grips the golf putter of FIG. 3, FIG. 6 is a schematic view for showing connections among points of FIG. 5 to explain a putting method using the golf putter of the present invention, and FIG. 7 is a schematic view for showing the relationships among the points of FIG. 5 looking down from the head of the golfer.

As shown in FIG. 3, the golf putter of the present invention includes a shaft 2 which serves as a frame of the golf putter, a grip 1 which is located at an end (i.e., an upper portion) of the shaft 2 and gripped by a golfer, and a head 3 which is connected to the other end (i.e., a lower portion) of the shaft 2 and strikes a golf ball H in a predetermined target direction X. The target direction X is a direction along which the golf ball H advances. The shaft extends up to the end of a first grip portion through the grip.

The grip 1 is gripped by both hands of the golfer during putting and may be formed of various materials such as synthetic resin, rubber, wood, or the like. Also, the grip 1 is formed so that the shaft 2 extends to an upper end of the grip 1 through a central portion of the grip 1.

The shaft 2 and the head 3 may be generally formed of a metallic material and may be a shaft and a head of a conventional golf putter. Thus, the detailed descriptions of the shaft 2 and the head 3 will not be provided herein.

As shown in FIG. 3, the grip 1 includes a first grip portion 11 (i.e., an upper portion which is gripped by one hand of the golfer) and a second grip portion 12 (i.e., a lower portion which is gripped by the other hand of the golfer).

The first grip portion 11 is gripped by a hand of the golfer located in the predetermined target direction X, and the second grip portion 12 is gripped by the other hand of the golfer located in the opposite direction to the predetermined target direction X. In other words, in a case of a right-handed golfer, as shown in FIG. 5, the first grip portion 11 is gripped by a left hand LH of the right-handed golfer, and the second grip portion 12 is gripped by a right hand RH of the right-handed golfer. Although not shown, in a case of a left-handed golfer, the first grip portion 11 is gripped by a right hand of the left-handed golfer, and the second grip portion 12 is gripped by a left hand of the left-handed golfer. Hereinafter, the first and second grip portions 11 and 12 will be explained assuming that the golfer is right-handed. In a case of the left-handed golfer, the first and second grip portions 11 and 12 will be opposite.

The first grip portion 11 includes a first protrusion 111 which protrudes in a direction opposite to the predetermined target direction X. According to an embodiment of the present invention, the first protrusion 111 may be formed at a side of an end of the first grip portion 11. As shown in FIG. 3, the grip 1 has a constant curvature to protrude from the second grip portion 12 to the first protrusion 111 in a direction toward the predetermined target direction X.

As shown in FIG. 5, the golfer grips the first grip portion 11 including the first protrusion 111 with the left hand LH. According to an aspect of the present invention, the first protrusion 111 protrudes only to be supported by the left hand LH of the golfer.

After gripping the first grip portion 11, the golfer supports a right arm RA with a thumb and a forefinger of the left hand LH. Here, the thumb and the forefinger of the left hand LH can support a front side of an elbow of the right arm RA. However, the left hand LH gripping the first protrusion 111 itself may support the front side of the elbow of the right arm RA. Hereinafter, the center of a portion of the right arm RA contacting a portion of the left hand LH is referred to as a contact point F (refer to FIG. 5). The important fact is that an F-E section is formed (discussed in more detail below) using the entire left hand regardless of the positions of fingers of the left hand LH.

As described above, when the right and left hands RH and LH of the golfer grip the first and second grip portions 11 and 12, respectively, an A-B-C triangle composition is formed and maintained by both shoulders A and B of the golfer and a wrist joint C of the right hand RH of the golfer gripping the second grip portion 12 as shown in FIG. 5. Another triangle is made by the wrist joint C of the right hand RH, the contact point F, and a wrist joint E of the left hand LH gripping the first grip portion 11 including the first protrusion 111. This will be explained in more detail below.

As shown in FIGS. 5 and 6, from a front view of the golfer who takes the posture to address the ball using the golf putter of the present invention, both shoulders of the golfer are denoted by reference characters A and B, and the wrist joint of the right hand RH of the golfer gripping the second grip portion 12 is denoted by reference character C. Here, the golfer grips a portion of the second grip portion 12 meeting with a shaft line of the shaft 2 with the right hand RH naturally spread.

For addressing the ball, the golf ball H is located to be perpendicular to the head of the golfer and advances along the predetermined target direction X once struck by the putter. Reference character D denotes a stroke point of a stroke face of the head 3.

As previously described, the left hand LH of the golfer grips the entire first grip portion 11 including the first protrusion 111. The wrist joint of the left hand LH gripping the first grip portion 11 is denoted by reference character E. The contact point between the right and left arms RA and LA (i.e., the center of the front side of the elbow of the right arm RA supported by the thumb and the forefinger of the left hand LH) is denoted by reference character F.

The thumb and the forefinger of the left hand LH contacts the right arm RA in the shape of V. Thus, the left hand LH is in contact with the right arm RA and a distance between the contact point F and the wrist joint E can be maintained during a swing motion for striking the golf ball H in the predetermined target direction X. Due to the fixation of the left hand LH to the right arm RA, left and right portions of the body of the golfer meet each other, which allows the shape and balance of the entire body of the golfer to be maintained during putting.

As shown in FIG. 7, a line E-F connecting the wrist joint E and the contact point F is nearly parallel with the predetermined target direction X. Thus, the stroke face of the head 3 is at a right angle to the predetermined target direction X while addressing the ball and during impact of the putter with the ball. Therefore, the above-described structure can serve as a direction key and thus contribute to easily maintaining an accurate direction.

While addressing the ball, as shown in FIG. 6, the shoulder points A and B and the wrist point C of the right hand RH form the A-B-C triangle composition, and the wrist point C of the right hand RH, the wrist point E of the left hand LH, and the contact point F forms a small C-E-F triangle.

A side A-C of the A-B-C triangle made by the shoulder point A and the wrist point C and a side F-C of the C-E-F triangle made by the contact point F and the wrist point C, represent that the golfer spreads the right hand RH. Thus, the lengths of the sides A-C and F-C do not vary during putting. Also, a side C-E of the C-E-F triangle made by the wrist points C and E depends on the length of the grip 1, and thus the length of the side C-E is maintained during putting regardless of the shape of the grip 1. The length of a side E-F of the C-E-F triangle made by the wrist point E and the contact point F may be maintained between fingers and wrist of the left hand LH during putting.

The length of a side B-E made by the shoulder point B and the wrist point E may be maintained by intentional practice. Also, the left and right portions of the body of the golfer meet at the point F. Thus, the left and right portions of the body of the golfer may be easily balanced by the sense of the golfer only through a little practice.

In particular, the structure of the C-E-F triangle may be easily maintained by minimizing variations of the lengths and angles of the sides C-E, E-F, and F-C. Thus, the composition of the A-B-C triangle can be very easily maintained from the address to the impact.

In other words, in a case of using the conventional golf puffer, the golfer moves joints of both arms and both wrists during putting and thus cannot maintain a triangle composition for an address posture. However, in a case of using the golf putter of the present invention, a golfer can easily maintain the triangle composition during putting and thus perform more stable, correct putting.

As shown in FIG. 3, in the golf putter of the present invention, the second grip portion 12 includes a second protrusion 121 which protrudes in a direction opposite to the predetermined target direction X. As shown in FIG. 5, the second protrusion 121 is formed so that the right hand RH of the golfer grips the second grip portion 12 with the wrist of the right hand RH bent. Thus, the golfer can conveniently grip the second grip portion 12. Also, due to the bending of the wrist of the right hand RH, a change of an angle of the wrist of the right hand RH may be minimized, and thus a stable, correct putting may be performed.

As shown in FIG. 6, in order to maintain the compositions of the A-B-C triangle and the C-E-F triangle inside the A-B-C triangle, it is preferable that the shaft 2 is slanted at a predetermined angle to the ground. The second protrusion 121, which protrudes to a predetermined degree toward a direction in which the right hand RH grips the second protrusion 121, is needed to easily grip the grip 1 that is slanted by the slanted shaft 2 with the wrist of the right hand RH naturally bent. Thus, the golfer can maintain a stable triangle composition from the address to the impact using the second protrusion 121.

The second protrusion 121 is formed so as to contact with a-portion of a palm of the right hand RH when the golfer grips the second grip portion 12 with the right hand RH.

Accordingly, as shown in FIG. 3, the second protrusion 121 together with the first protrusion 111 allows the grip 1 to have a curved portion. In other words, as shown in FIG. 3, the grip 1 may be bent to protrude from the first protrusion 111 to the second protrusion 121 toward the predetermined target direction X. Upper and lower ends of the grip 1 may protrude toward the opposite direction to the direction along which the golf ball H advances and be connected to each other to have a gently curved portion. Thus, the grip 1 may be formed so that the central portion of the grip 1 protrudes toward the direction along which the golf ball H advances. Here, the shaft 2 may extend up to the upper end of the grip 1.

As shown in FIG. 4, when taking a side view of the grip 1, the grip 1 may be formed so that the thickness of the grip 1 hardly varies.

As described above, when a golfer uses a golf putter according to the present invention, the golfer can grip the golf putter while an arm is naturally stretched while addressing the ball. Thus, the golfer cannot bend the arm or a wrist of the arm during a swing motion. Therefore, a golfer can easily and stably maintain a triangle composition formed while addressing the ball until the golfer finishes a putting motion. As a result, the golfer can perform an accurate swing motion. Also, a portion of a grip gripped by a left or right hand of the golfer can contact a right arm of the golfer and thus serve as a direction key and help maintain an accurate direction.

As shown in FIG. 3, since the shaft 2 of the present invention extends up to the end of the first grip portion 11 through the grip 1, the golf putter of the present invention comply with the rules of the R&A and the USGA as of the application date of the present invention and thus may be used for practice as well as for sanctioned golf games.

The golf putter of the present invention may be used for practice and sanctioned golf games, and the technical sprit of the present invention may be applied to other kinds of golf clubs.

What is claimed is:

1. A golf putter comprising:

a shaft;

a grip located at an end of the shaft; and a head which is connected to the other end of the shaft and which strikes a golf ball in a target direction, wherein the grip comprises:

a first grip portion, wherein a side of an end of the first grip portion protrudes in a direction opposite to the target direction; and a second grip portion which extends from the first grip portion toward the head and is curved, wherein the shaft extends up through the second grip portion to the end of the first grip portion through the grip and is straight from the second grip portion to the end of the first grip portion through the grip.

2. The golf puffer of claim 1, wherein at least a side of an end of the second grip portion facing the direction opposite to the target direction protrudes in a direction opposite to the target direction.

3. The golf putter of claim 2, wherein the grip is curved from the protruding side of the end of the second grip portion to the protruding side of the end of the first grip portion in the target direction.

4. The golf putter of claim 1, wherein the grip is curved from the protruding side of the end of the first grip portion to the second grip portion.

5. The golf putter of claim 1, wherein a substantially central portion of the grip protrudes in the target direction.

6. A golf putter comprising:

a shaft;

a grip located at an end of the shaft; and a head which is connected to the other end of the shaft and which strikes a golf ball in a target direction, wherein the grip comprises:

a first grip portion, wherein an end of the first grip portion protrudes in a direction opposite to the target direction and wherein the end of the first grip portion is shaped and dimensioned to be gripped by a hand of a golfer located in the target direction; and a second grip portion which extends from the first grip portion toward the head in a curved fashion and wherein the second grip portion is shaped and dimensioned to be gripped by a hand of the golfer located in the opposite direction to the target direction, wherein the grip is further shaped and dimensioned so at least one finger of the hand gripping the first grip portion does not grip the first grip portion and contacts a contact point of an inner portion of an elbow of an arm located in the opposite direction to the target direction, so that a wrist joint of the hand gripping the second grip portion, the contact point, and a wrist joint of the hand gripping the first grip portion maintain a triangle composition; and wherein the shaft extends up trough the second grip portion to the end of the first grip portion through the grip and is straight from the second grip portion to the end of the first grip portion through the grip.

7. The golf putter of claim 6, wherein at least a side of an end of the second grip portion protrudes in the direction opposite to the target direction and contacts an inner portion of the hand of the golfer located in the opposite direction to the target direction, and the hand of the golfer gripping the second grip portion forms a predetermined angle with an arm comprising the hand, based on a wrist joint of the hand gripping the second grip portion.

8. The golf puffer of claim 7, wherein the grip is curved from the protruding side of the end of the second grip portion to the protruding side of the end of the first grip portion toward the target direction.

9. The golf putter of claim 6, wherein the grip is curved from the protruding side of the end of the first grip portion to the second grip portion.

10. The golf putter of claim 6, wherein the shaft extends up to the end of the first grip portion through the grip.

11. The golf putter of claim 6, wherein a substantially central portion of the grip protrudes in the target direction.

* * * * *